US006764148B2

(12) United States Patent
Morris et al.

(10) Patent No.: US 6,764,148 B2
(45) Date of Patent: Jul. 20, 2004

(54) DRAWER LATCH MECHANISM

(75) Inventors: Laura Morris, Willow Springs, IL (US); Shailesh Patel, Brooklyn, NY (US); Peter Graves, Palos Park, IL (US); Paul Mann, Oak Park, IL (US); Michael Thuma, LaGrange, IL (US); Ron Llanes, Lisle, IL (US)

(73) Assignee: Home Products International, Inc., Chicago, IL (US)

( * ) Notice: Subject to any disclaimer, the term of this patent is extended or adjusted under 35 U.S.C. 154(b) by 97 days.

(21) Appl. No.: 10/044,509

(22) Filed: Jan. 11, 2002

(65) Prior Publication Data

US 2003/0132687 A1 Jul. 17, 2003

(51) Int. Cl.[7] ..... E05C 1/06

(52) U.S. Cl. ..... 312/332.1; 312/222; 312/333; 292/163

(58) Field of Search ..... 312/333, 332.1, 312/330.1, 215, 222; 292/1, 137, 157, 159, 163, 164, 165, 180, DIG. 30, DIG. 32

(56) References Cited

U.S. PATENT DOCUMENTS

| | | | | | |
|---|---|---|---|---|---|
| 922,852 | A | | 5/1909 | Cannan | |
| 2,206,049 | A | | 7/1940 | Richardson | |
| 2,879,561 | A | | 3/1959 | Rieder | |
| 3,350,123 | A | | 10/1967 | Loving et al. | |
| 3,918,752 | A | | 11/1975 | Leone et al. | |
| 4,223,787 | A | * | 9/1980 | Lowry et al. | 292/163 |
| 4,355,585 | A | | 10/1982 | Bottamiller et al. | |
| 4,505,526 | A | | 3/1985 | Leck | |
| 4,688,023 | A | | 8/1987 | McGill et al. | |
| 4,838,626 | A | * | 6/1989 | Parr | 312/333 |
| 4,875,747 | A | | 10/1989 | Hollenstein | |
| 4,932,730 | A | * | 6/1990 | Zeismann et al. | 312/332.1 |
| 5,231,948 | A | * | 8/1993 | Malmanger et al. | 292/163 |
| 5,233,506 | A | | 8/1993 | Semenik et al. | |
| 5,253,142 | A | | 10/1993 | Weng | |
| 5,291,843 | A | | 3/1994 | Hori | |
| 5,344,226 | A | * | 9/1994 | Lee | 312/333 |
| 5,482,333 | A | * | 1/1996 | Gehrs et al. | 292/163 |
| 5,484,223 | A | | 1/1996 | Saito | |
| 5,509,704 | A | * | 4/1996 | Schneider et al. | 292/163 |
| 5,603,559 | A | * | 2/1997 | Yemini | 312/333 |
| 5,605,424 | A | | 2/1997 | Boville et al. | |
| 5,653,550 | A | | 8/1997 | Mutz et al. | |
| 5,795,044 | A | | 8/1998 | Trewhella, Jr. et al. | |
| 5,816,733 | A | | 10/1998 | Ishikawa et al. | |
| 5,931,514 | A | | 8/1999 | Chung | |
| 5,954,413 | A | * | 9/1999 | Brown | 312/222 |
| 6,053,726 | A | | 4/2000 | Kanno | |
| 6,161,909 | A | * | 12/2000 | Huang | 312/222 |
| 6,193,435 | B1 | | 2/2001 | Lafaye et al. | |
| 6,431,616 | B1 | * | 8/2002 | Julian | 292/171 |
| 6,457,789 | B2 | * | 10/2002 | Hallsten | 312/333 |

FOREIGN PATENT DOCUMENTS

| | | | |
|---|---|---|---|
| JP | 06189832 | * | 7/1994 |
| JP | 10146233 | * | 6/1998 |

* cited by examiner

*Primary Examiner*—Lanna Mai
*Assistant Examiner*—Hanh Van Tran
(74) *Attorney, Agent, or Firm*—Wood, Phillips, Katz, Clark & Mortimer

(57) ABSTRACT

A latch arrangement for a drawer includes a latching mechanism having a latch element and a latching mechanism-receiving structure formed as part of a drawer. The structure includes two integral spring elements for biasing the latching mechanism upwardly. The latching mechanism and the drawer have cooperating, snap-engageable retaining features that allow the latching mechanism to move over a vertical range of movement but retain the latching mechanism on the structure. The structure and the remaining portions of the drawer can be molded as a unitary plastic part. The latching mechanism can be molded as a second unitary plastic part.

13 Claims, 6 Drawing Sheets

DRAWER LATCH MECHANISM

TECHNICAL FIELD OF THE INVENTION

The present invention relates to latching mechanisms for drawers. Particularly, the invention relates to a latching mechanism for plastic drawers carried in a lightweight plastic stackable drawer cabinet structure.

BACKGROUND OF THE INVENTION

Storage systems are known which include stackable drawer cabinet structures each slidably supporting a drawer. Such arrangements typically comprise plastic cabinets and plastic drawers which are advantageously inexpensively manufactured, durable and lightweight. Drawer cabinets and drawers of varying depth can be selected for customized or consumer-selected stacked arrangements of drawer sizes.

With such arrangements, it is known to provide each individual drawer with a latching arrangement to ensure that once the individual drawer is closed to the respective drawer cabinet, the drawer is latched closed, and prevented from inadvertently opening due to being jostled, or overfilled, or the cabinet being slightly tipped. The use of latches ensures a neat storage system for storing household articles.

One such system utilizes a latch element having spring arms integrally formed therewith. The latch element is captured in a latch cover, the latch cover being attached to the front wall of the drawer. The latch element is spring biased to an elevated position to engage a latch receiving element of the drawer cabinet. The drawer-and-latch system thus utilizes at least three separate pieces: the drawer, the latch element and the cover.

Although such known drawer systems can provide satisfactory results, the present inventors have recognized the desirability of providing a drawer system with a latching mechanism which is, among other things, more cost effectively manufactured.

SUMMARY OF THE INVENTION

The present invention provides a drawer latching system that is cost effectively manufactured, is durable, and can be disassembled and reassembled easily for replacement or cleaning. The latching system is effectively used for drawers that are slidably carried by stackable drawer cabinets.

The present invention provides a latch arrangement for a drawer that includes a latch mechanism having a latch element, and a latch mechanism-receiving structure formed as part of the drawer. The structure includes an integral spring element for biasing the latch mechanism upwardly. The latch mechanism and the drawer have cooperating, snap-engageable retaining features that allow the latch mechanism to move over a vertical range of movement but retain the latch mechanism on the structure. The structure and the remaining portions of the drawer can be molded as a unitary plastic part. The latch mechanism can be molded as a second unitary plastic part.

According to one embodiment of the present invention, a drawer latching mechanism includes a latch body which incorporates a latch element, latch mechanism retaining tabs, a finger-actuatable surface and a guiding structure, all as a single unitary piece. The invention provides a drawer structure which includes a tab receiving structure for engagement of the latch mechanism retaining tabs of the latch body, retaining the latch body onto the drawer structure but allowing the latch body to slide on the drawer structure.

The drawer structure further includes spring elements which bias the latch body toward an elevated position on the drawer structure and are resiliently deflected by spring actuation elements of the latch body, when the latch body is moved to a depressed, latch-disengaged position. The spring actuation elements engage the spring elements of the drawer structure to resiliently bias the latch body toward its elevated position. The spring actuation elements also capture a front wall of the drawer structure between a front wall of the latch body and the spring actuation elements to guide a vertical sliding movement of said latch body from the elevated position to the lowered position of the latch element.

Above the drawer latching mechanism, the cabinet that carries the drawer provides an overlying front frame portion or other structure adjacent to a latch-receiving recess that is configured to receive the latch element to latch the drawer in its closed position. Accordingly, the latch element of the latch body includes a downwardly inclined face toward the front frame portion such that the downwardly inclined face, when pushed against the front frame portion during closing of the drawer to the drawer cabinet, forces the latch body to its lowered position. Once the latch element passes by the front wall structure during closing of the drawer, the latch element will rebound with the latch body to its elevated position, the latch element extending into the recess. The latch element includes a vertical latch face which abuts the front frame portion when the latch element is inserted into the recess, to prevent opening of the drawer. Once latched, the latched body must be manually depressed downwardly, such as by using a finger recess exposed on a front side of the latch body as a pushing point, to disengage the latch element from the recess.

The present invention latching mechanism is cost effectively manufactured in that it is effectively only one additional piece aside from the molded drawer structure. The drawer structure provides the mounting arrangement and the resilient elements for complete attachment and operation of the latch body. No intervening latch carrying plate attached to the drawer is needed. The drawer structure can be molded of a single piece with remaining portions of the drawer, and the latching mechanism can also be molded of a single piece, reducing material costs and simplifying the assembly of the drawer latching system.

The latch body can be easily removed from the drawer structure for cleaning or replacement by delatching the tabs from the slots by a pushing force from inside the drawer. The latch body can then be reinstalled simply by vertically pressing the latch body into the drawer structure until the tab members snap-lock into the guiding slots of the drawer structure.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
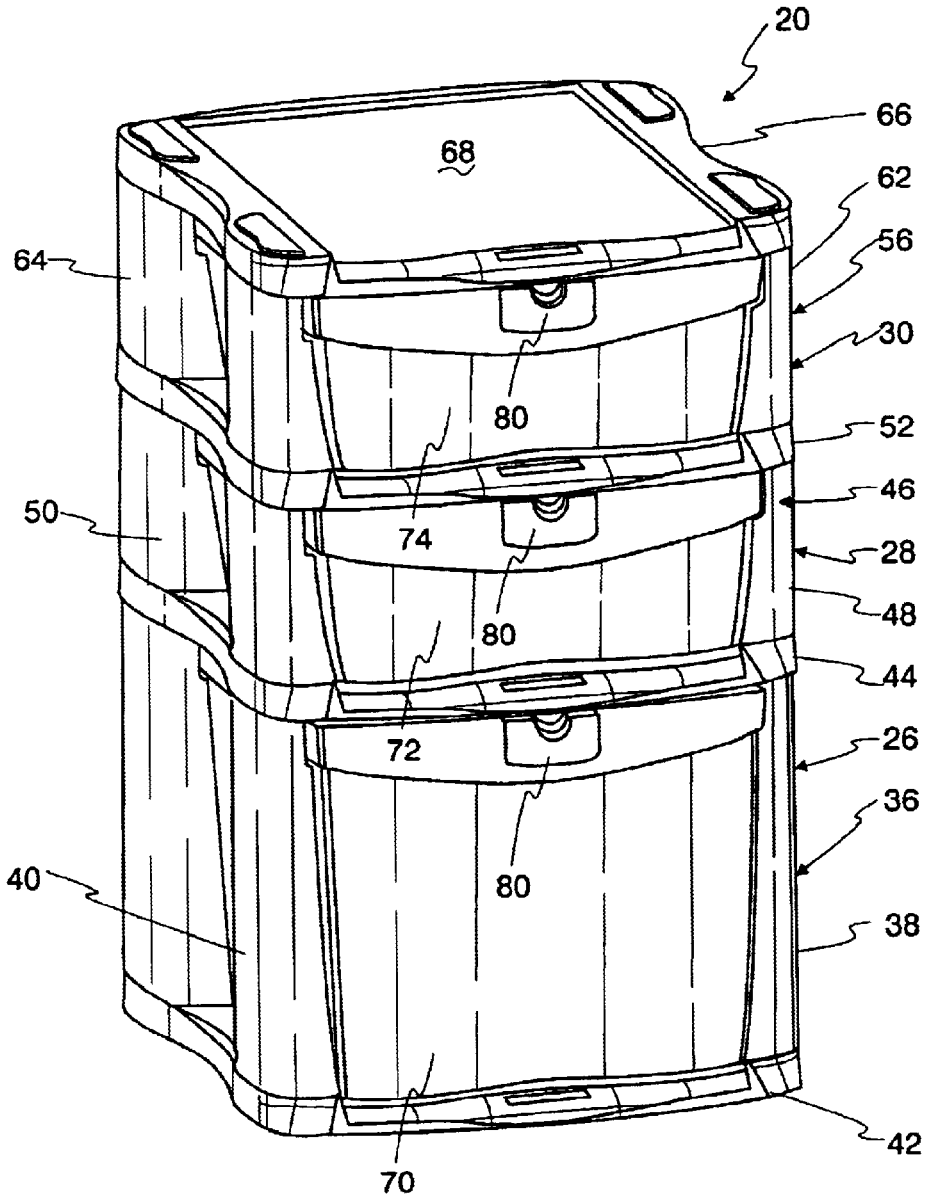
FIG. 1 is a perspective view of a plurality of drawers carried with drawer cabinets, the drawer cabinets and drawers being in a vertically stacked arrangement.

While this invention is susceptible of embodiment in many different forms, there are shown in the drawings, and will be described herein in detail, a specific embodiment thereof, with the understanding that the present disclosure is to be considered as an exemplification of the principles of the invention and is not intended to limit the invention to the specific embodiment illustrated.

FIG. 1 illustrates a stacked drawer assembly 20 including a plurality of drawer assemblies 26, 28, 30 of variable volumes arranged in a vertically stacked alignment. The bottom drawer assembly 26 includes a drawer cabinet 36 having opposing sidewalls 38, 40, a bottom wall 42 and a top wall 44. The top wall 44 serves as the bottom wall of the overlying drawer assembly 28. The drawer assembly 28 includes a drawer cabinet 46 having sidewalls 48, 50 and an overlying top wall 52. The top wall 52 serves as a bottom wall of the overlying drawer cabinet 30. The drawer cabinet 30 includes a drawer cabinet 56 having sidewalls 62, 64 and a top wall 66. The top wall 66 includes a central panel 68. The panel 68 can be omitted from the walls 52, 44 and 42, if desired.

The drawer cabinets 36, 46, 56 carry drawers 70, 72, 74, respectively. Each of the drawers 70, 72, 74 includes a latching mechanism 80 as described below.

Figure 2:
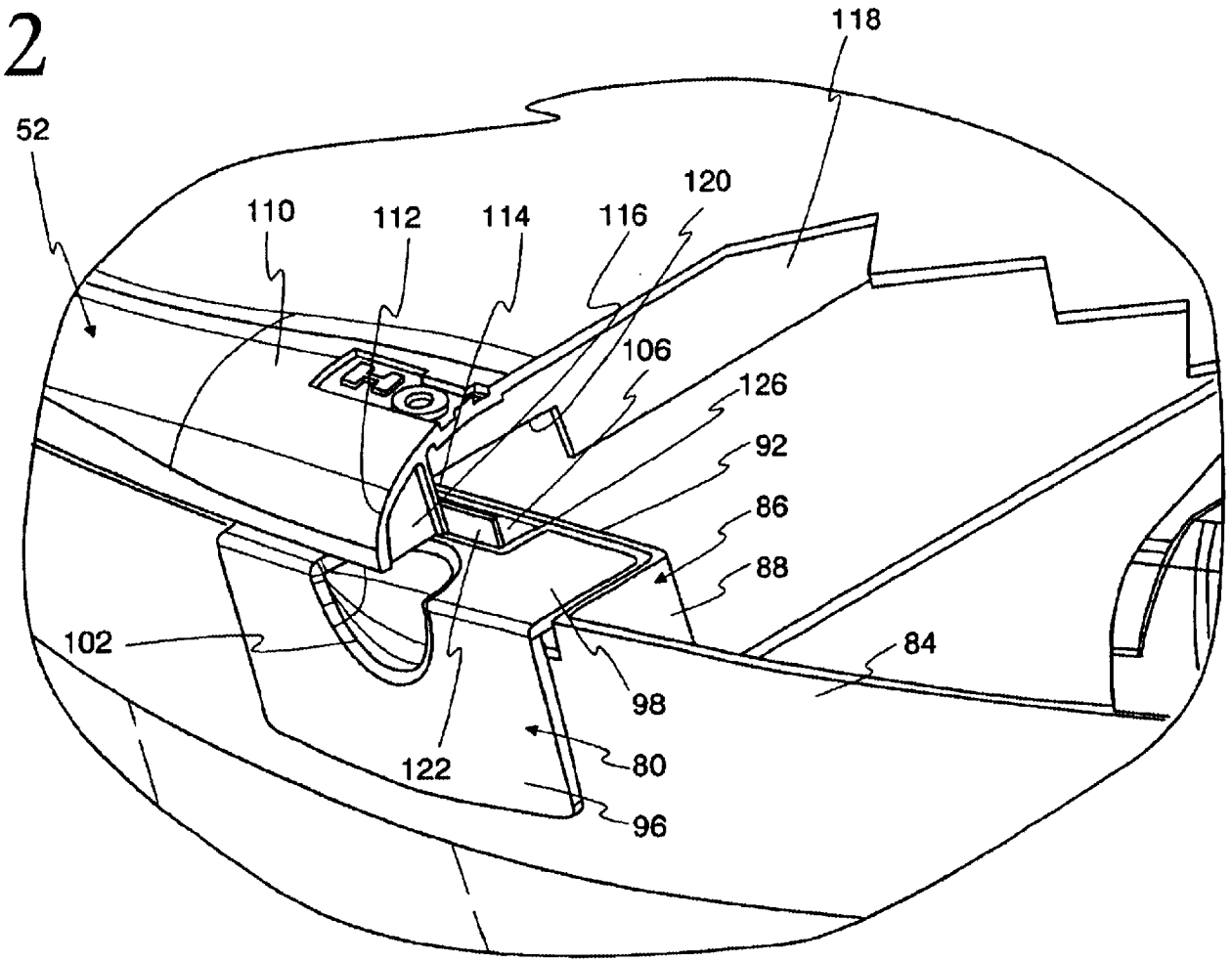
FIG. 2 is a fragmentary, enlarged perspective view of a portion of a drawer and drawer cabinet shown in FIG. 1.

FIG. 2 illustrates the latching mechanism 80 fit on the drawer 72, as an example. The drawer 72 includes a front wall 84, and a rearwardly extending compartment 86 formed with the front wall 72. The compartment 86 includes sidewalls 88, 90 (shown in FIGS. 5 and 6) and a rear wall 92. The latching mechanism 80 includes a front wall portion 96, a top wall portion 98 and a quarter-spherical recess 102 extending from the front and top walls. A wedge-shaped latch 106 extends upwardly from the top wall 98.

The overlying wall 52 of the cabinet 46 includes a front rim portion 110 having a curved front wall 112 and a straight back wall 114 reinforced by one or more perpendicular ribs 116. The walls 112, 114 and ribs 116 provide for a rigid construction of the wall 52. The rib 116 further provides a block such that the latch 106 does not enter the space defined between the walls 112, 114 during drawer closing.

The wall 52 further includes an elongated rib reinforcement 118 substantially aligned with the rib 116. The rib reinforcement 118 includes a rectangular recess 120 adjacent the rear wall 114. The recess 120 is sized to allow the entry of the latch element 106 therein to latch the latching mechanism 80 to the wall 52. The latch element 106 includes a substantially vertical front wall 122 for latching abutment against the wall 114, and a rearwardly declined front face 126 which assists in the vertical depression of the latching mechanism 80 during closing of the drawer to the wall 52 by abutment of the face 126 with the wall 112.

Figure 3:
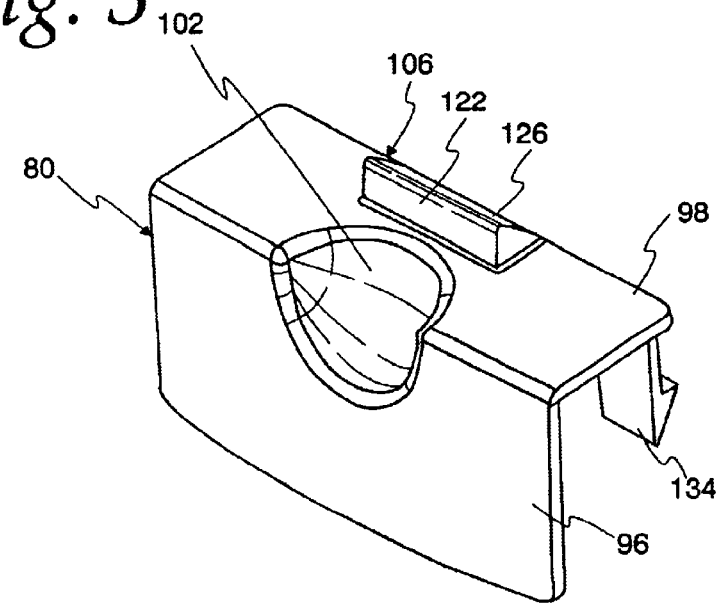
FIG. 3 is a perspective view of a drawer latch body taken from FIG. 1.
Figure 4:
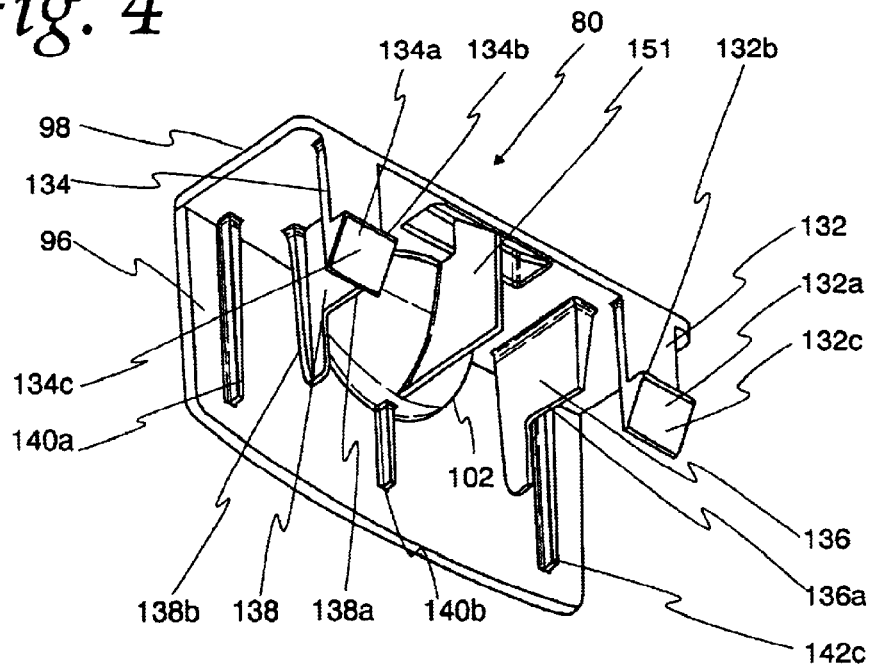
FIG. 4 is a rear perspective view of the latch body shown in FIG. 3.

FIGS. 3 and 4 illustrate the latching mechanism 80 in more detail, separate from the drawer structure. Particularly viewing FIG. 4, the latching mechanism 80 includes locking tabs 132, 134 extending downward from the top wall 98. The locking tabs 132, 134 each include a tapered head portion 132*a*, 134*a* having a retaining surface 132*b*, 134*b*.

Extending downwardly from the top wall are spring actuation elements 136, 138 which are spaced from the front wall 96 along their length and which also provide spring actuation abutment surfaces 136*a*, 138*a*, the function of which will be described hereinafter. The spring actuation elements 136, 138 are reinforced by ribs 136*b*, 138*b* (136*b* not shown but identical in mirror image fashion to 138*b*).

The front wall 96 is also reinforced by ribs 140*a*, 140*b*, 140*c*. A central web 151 connects the recessed quarter-spherical portion 102 with the top wall 98 and into a void created by the raised latch element 106.

Figure 5:
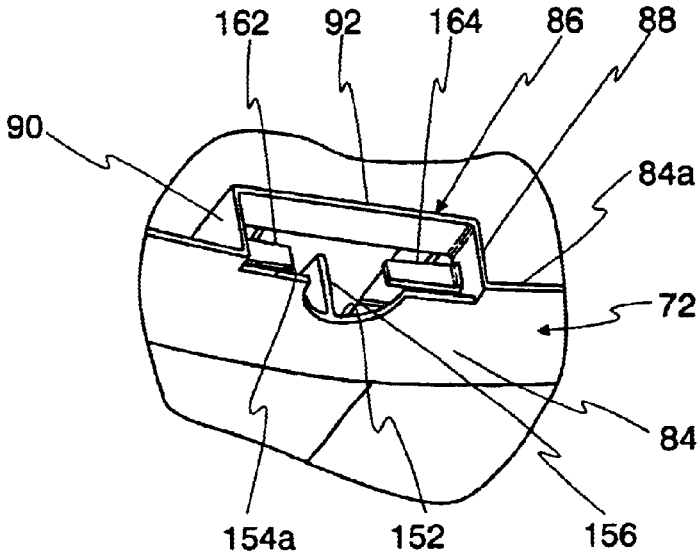
FIG. 5 is a fragmentary perspective view of a portion of a drawer structure, with the latch body removed in order view the underlying structure.
Figure 6:
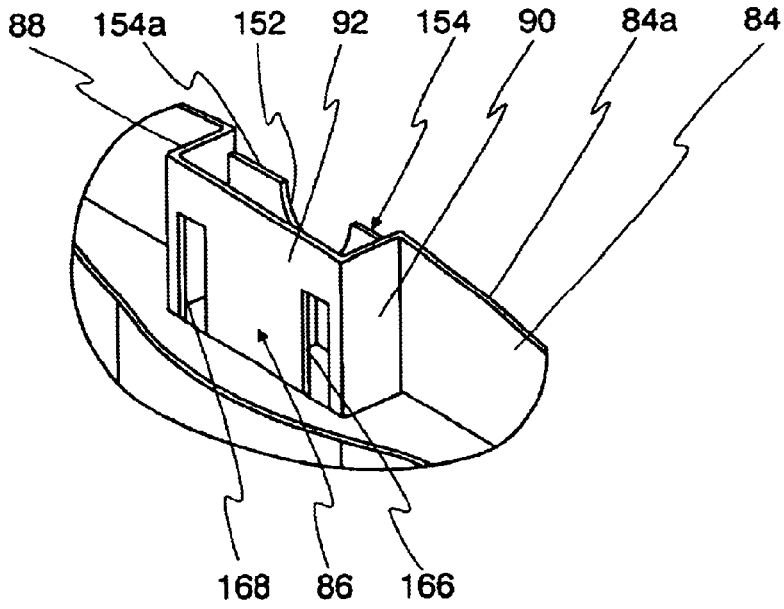
FIG. 6 is a rear perspective view of the drawer structure of FIG. 5.

FIGS. 5 and 6 illustrate the compartment 86 of the drawer 72. The compartment 86 includes a semicircular recess 152 on a top edge of the front wall 84 which is open into a rectangular recess 154 having a top edge 154*a*, the recess 154 extending below a top edge 84*a* of the front wall 84. Extending rearwardly from the front wall 84 is a reinforcing web 156 that is connected to the rear wall 92. Extending inwardly from the sidewalls 88, 90 are cantilever spring arms 162, 164.

As shown in FIG. 6, the rear wall 92 includes two vertical slots 166, 168 that each receives one of the locking tabs 132, 134 of the latching mechanism 80.

Figure 7:
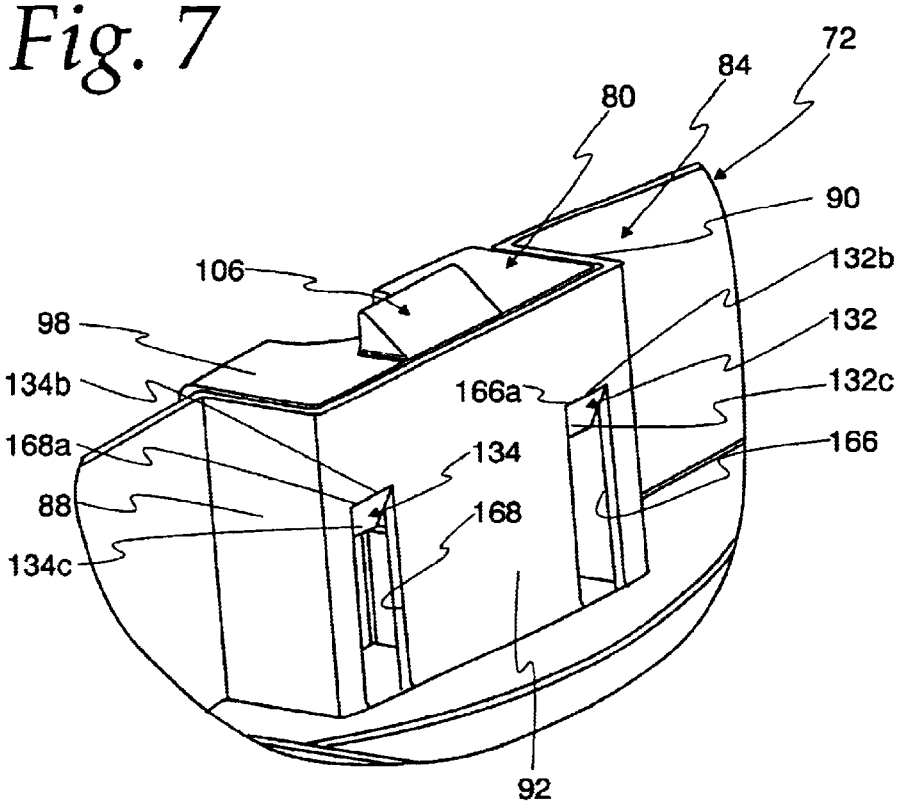
FIG. 7 is a fragmentary rear perspective view of a drawer structure with the latch body engaged thereto.

FIG. 7 illustrates the latching mechanism 80 in its elevated position, fit within the compartment 86 of the drawer front wall 84. The locking tab tapered head portions 132*a*, 134*a* have been downwardly slid against an inside surface of the rear wall 92. The tabs 132, 134 resiliently deflect inwardly during the downward sliding movement, as the elements 136, 138 downwardly slide and press against an inside surface of the front wall 84, until the head portions 132*a*, 134*a* are received into the slots 166, 168 with the retaining surfaces 132*b*, 134*b* retained from further upward vertical movement by top limits 166*a*, 168*a* of the slots 166, 168. To facilitate the insertion of the latching mechanism 80 into the compartment and the deflection of the tabs during installation, the head portions 132*a*, 134*a* have oblique faces 132*c*, 134*c* which slide against the inside surface of the rear wall 92.

Figure 8:
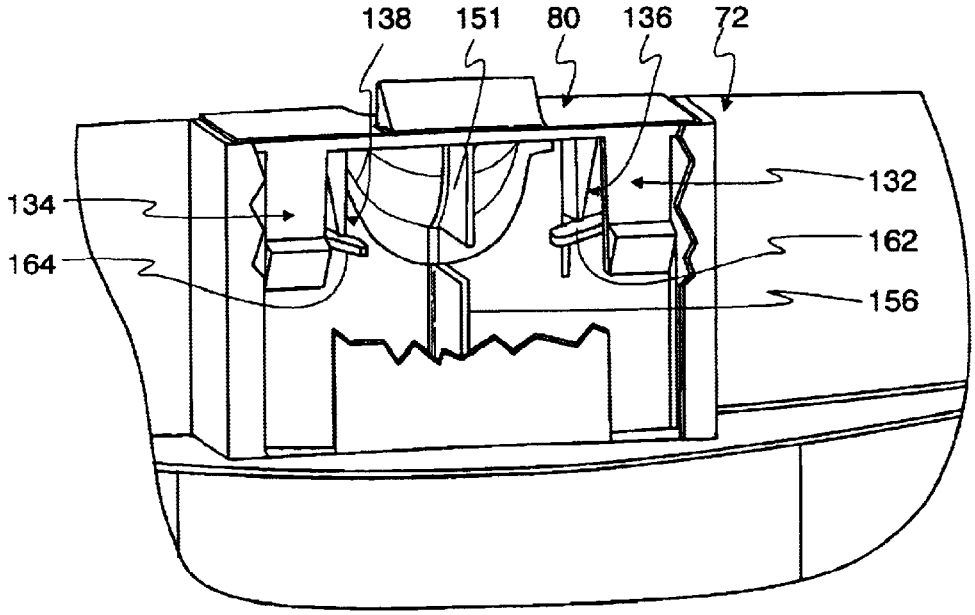
FIG. 8 is a fragmentary rear perspective view of the drawer structure and latch body of FIG. 7, with a portion of the rear wall of the drawer structure removed in order to view the interaction of the latch body with the drawer structure.

FIG. 8 illustrates the spring actuation elements 136, 138 slightly depressing the cantilever spring arms 162, 164 due to the snap engagement of the locking tabs 132, 134 in the slots as shown in FIG. 7. The central web 156 is vertically aligned with the reinforcing web 156 with a space therebetween to allow for relative vertical movement of the latching mechanism 80 with respect to the drawer 72.

Figure 9:
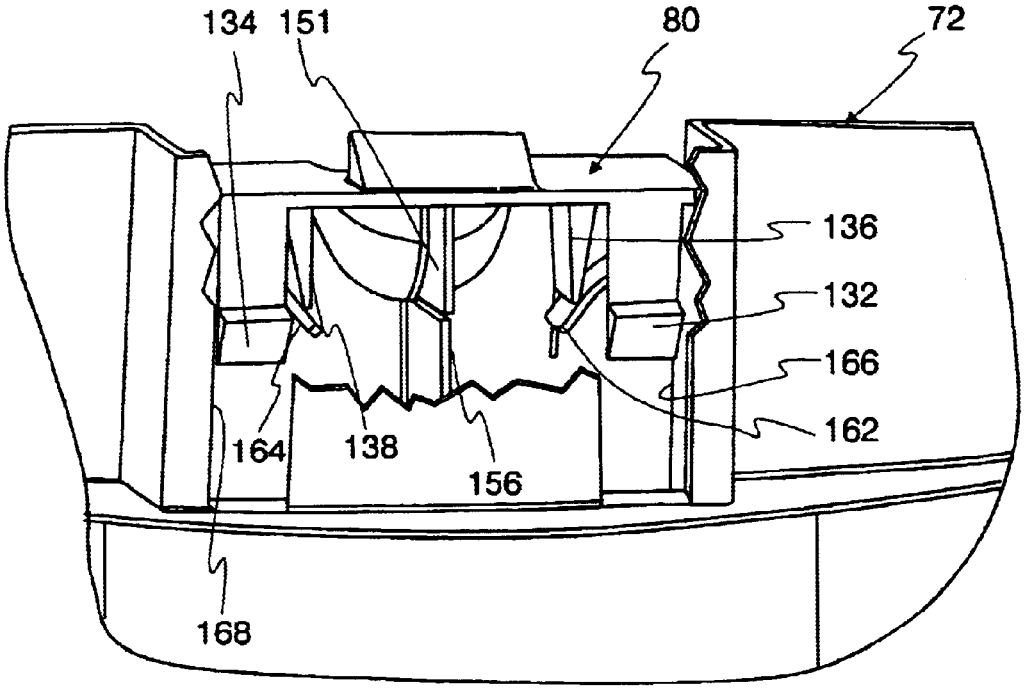
FIG. 9 is a fragmentary rear perspective view as shown in FIG. 8 but with the latch body depressed as occurs during disengagement of the drawer from the drawer cabinet.

FIG. 9 is a view similar to FIG. 8 but showing the latching mechanism 80 in a vertically lowered position with respect to the drawer 72. The spring actuation elements 136, 138 have more drastically deflected the cantilever spring arms 162, 164. The central web 151 has reached a position adjacent to or abutting the reinforcing web 156. The tabs 132, 134 have vertically translated through the slots 166, 168 without interference.

When assembled, the spring actuation elements 136, 138 are spaced from the front wall 96 of the latching mechanism

80 with a clearance to closely receive the front wall 84 of the drawer 72 between the spring actuation elements 136, 138 and the front wall 96 of the latching mechanism 80. This acts to guide the vertical movement of the latching mechanism 80 with respect to the drawer 72. Additionally, the top edge 154*a* of the rectangular recess 154 provides a vertical limit stop of an underside of the top wall 98.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims, all such modifications as fall within the scope of the claims.

The invention claimed is:

1. A latch arrangement for a drawer, comprising:

a latching mechanism having a latch element carried on a latch body;

a drawer having a wall portion wherein one of said wall portion and said latch body has a vertical slot and the respective other has a latching tab moveable along said vertical but having a portion preventing vertical separation of said latching tab from said wall portion, said vertical slot allowing a vertical range of motion of said latch body but preventing vertical removal of said latch body from said wall portion, one of said latch body and said wall portion having a spring element, said spring element comprises at least one cantilever spring arm extending substantially horizontally from said wall portion and engaged by said latch body, said spring element urging said latch body upwardly to an elevated position; and said latch body comprising a pressable surface arranged for manually depressing said latch body with respect to said wall portion.

2. The arrangement according to claim 1, wherein said pressable surface comprises a quarter-spherically shaped recess.

3. A drawer latching arrangement comprising:

a latching mechanism having a latch body, said latch body comprising a top wall and a contiguous front wall, two spaced-apart spring actuation elements extending from an underside surface of said top wall substantially perpendicularly to said top wall, and two locking tabs extending perpendicularly from the underside surface of said top wall spaced-apart along a back edge of said top wall, said locking tabs having tapered heads at free ends thereof;

a latch element protruding from a top surface of said top wall; and a drawer having a front wall and a latching mechanism-carrying compartment formed on said front wall, said compartment comprising side walls and a rear wall, and a recessed front wall, said rear wall having vertical slots sized and arranged to receive said locking tabs of said latching mechanism to retain said latching mechanism at least partially within said compartment, said sidewalls comprising cantilever spring arms extending perpendicularly therefrom toward an inside of said compartment, said spring arms arranged to be deflected by said spring actuation elements upon depression of said latch body deeper into said compartment, said top wall of said latch body moveable vertically with respect to said compartment a distance into said recessed front wall of said compartment.

4. The arrangement according to claim 3, wherein said latch body comprises a quarter-spherical recess on a front side thereof sized to allow insertion of a fingertip to depress said latching mechanism with respect to said compartment.

5. The arrangement according to claim wherein 3, wherein said compartment is molded in unitary fashion with said remaining portions of said drawer.

6. The arrangement according to claim 3, wherein said latching mechanism is a unitary molded plastic part.

7. A latch arrangement for a drawer, comprising:

a latch mechanism having a latch element;

a drawer having a latching mechanism-receiving structure, said structure including a spring element for biasing said latching mechanism upwardly; said spring element comprises at least one cantilever finger arm extending substantially horizontally and engaged by said latching mechanism;

said latching mechanism and said drawer having cooperating, snapengeable retaining features that allow said latching mechanism to move over a vertical range of movement but retain the latching mechanism on said structure, said structure being a molded plastic part.

8. The arrangement according to claim 2, wherein said structure comprises at least one vertically oriented slot having an upper limit and said latching mechanism comprises a snap-latching tab having a head portion movable within said slot, said head portion abutting said upper limit when moved to an upper vertical position.

9. The arrangement according to claim 8, wherein said drawer and said latch mechanism-receiving structure are molded as a unitary part.

10. The arrangement according to claim 9, wherein said latching mechanism is molded as a unitary part.

11. The arrangement according to claim 3, wherein said latching mechanism comprises a pressable surface arranged for manually depressing said latching mechanism with respect to said structure.

12. The arrangement according to claim 3, wherein said pressable surface comprises a quarter-spherically shaped recess.

13. The arrangement according to claim 3, wherein said latching mechanism comprises a latch body, said latch body comprising a top wall and a contiguous front wall, a spring actuation element extending from an underside surface of said top wall substantially perpendicularly to said top wall, and at least one locking tab extending perpendicularly from the underside of said top wall on a back edge of said top wall;

said structure comprising a wall having a vertical slot sized and arranged to receive said locking tab to limit upward vertical movement of said latch body, and said spring element comprises a cantilever spring arm extending horizontally from said structure, said spring arm arranged to be deflected by said spring actuation element upon depression of said latch body, said top wall of said latch body moveable vertically with respect to said structure.

* * * * *